US005172624A

United States Patent [19]

Mentzendorff

[11] Patent Number: 5,172,624

[45] Date of Patent: Dec. 22, 1992

[54] HYDRAULIC DEVICE

[75] Inventor: Olaf Mentzendorff, Hanover, Fed. Rep. of Germany

[73] Assignee: WABCO Westinghouse Fahrzeugbremsen GmbH, Hanover, Fed. Rep. of Germany

[21] Appl. No.: 657,501

[22] Filed: Feb. 19, 1991

[30] Foreign Application Priority Data

Feb. 20, 1990 [DE] Fed. Rep. of Germany ..... 4005296

[51] Int. Cl.[5] ..... F15B 13/00

[52] U.S. Cl. ..... 91/516; 91/517; 137/116; 137/118

[58] Field of Search ..... 60/422, 426; 91/516, 91/517; 137/116, 118

[56] References Cited

U.S. PATENT DOCUMENTS 4,105,041 8/1978 Axthammer ..... 137/116
4,199,941 4/1980 Farr ..... 60/413
4,332,270 6/1982 Budecker ..... 137/118
4,503,876 3/1985 Farr ..... 137/116

FOREIGN PATENT DOCUMENTS 1233223 2/1963 Fed. Rep. of Germany .

*Primary Examiner*—Edward K. Look
*Assistant Examiner*—F. Daniel Lopez
*Attorney, Agent, or Firm*—Horst M. Kasper

[57] ABSTRACT

A hydraulic device is furnished for an automatic connection of the pressure means source, either preferably to the primary user or to the secondary user depending on the pressure in the circuit of the primary user. A switching valve can be actuated by way of a precontrol pilot valve for the generation of the connections. An additional restoring second part compression spring (33) with adjustable pretension acts on the precontrol pilot valve (19, 20, 21, 22, 27). A fluid-loadable auxiliary piston (32) serves for a switching-pressure support. The hydraulic device is suitable for applications in hydraulic circuits exhibiting different transport priorities to different ports.

17 Claims, 4 Drawing Sheets

HYDRAULIC DEVICE

BACKGROUND OF THE INVENTION

1. Field of the Invention

The invention relates to a hydraulic device for the automatic connection of a pressure means source, dependent on the pressure in the circuit of a primary user, either preferably with the primary user or with a secondary user.

2. Brief Description of the Background of the Invention Including Prior Art

A device of the kind recited above is known from the German printed Patent Application DE-OS 3,347,637. The device taught in the German printed Patent Publication DE-OS 3,347,637 includes a switch valve of the kind of a pressure balance, by way of which the pressure means source can be connected or, alternatively, blocked relative to the secondary user.

In case of blocking of the pressure means source versus the secondary user, the pressure means source is predominantly connected with the primary user. The actuation of the switch valve is performed with the aid of a precontrol pilot valve, controllable with the pressure of the primary user. A pressure control chamber of the switch valve is connected either with the pressure means source or with a pressureless storage container.

The switching from one switching position into a second switching position is to occur rapidly and quickly, i.e. it is to be avoided that an unstable switching state occurs during a critical pressure phase in the primary circuit in the neighborhood of the switching pressure of the precontrol pilot valve. An unstable switching state renders the complete separation of the two user circuits from each other more difficult.

The device taught in the German printed Patent Publication DE-OS 3,347,637 solves this general problem in that the precontrol pilot valve is provided with pressure-subjectable active transfer faces having different dimensions. Pressure is simultaneously applied to or released from, one of the active transfer faces of the precontrol pilot valve by the switch valve. The force application or the force release, respectively, acting thereby additionally on the precontrol pilot valve, allows the change between two stable switch positions.

Simultaneously, this additionally acting force also provides a measure for the pressure difference of the pressures in the primary circuit, at which pressures the precontrol pilot valve reverses its control state. It is a disadvantage in this context that, according to the German printed Patent Publication DE-OS 3,347,637, the ratio of the active transfer faces and thus the effect of the active transfer faces onto the switching pressure difference of this device are prespecified. Therefore, adjustment possibilities of the switching range for balancing of construction tolerances which occur particularly in the size tolerance of the valve covering of the precontrol pilot valve and in the non-uniform characterizing curves of the springs, are not realizable with safety and certainty.

On the other hand, small switch and pressure differences can be implemented only with difficulty, since a safe change between the switching positions is not assured in case of too small a ratio of the active transfer faces relative to each other.

The German printed Patent Publication DE-AS 1,233,223 to Jean Mercier teaches a pressure control valve for hydraulic plants. The reference teaches to use a cylindrical piston having a cylindrical section 24 and a conical section 25, where the conical part 24 forms a sealing face. The piston 23 forms the closure member of the relief valve V. The reference employs a storage container 10 and illustrates a line 18 connected to the pressure storage U. While the reference teaches a number of elements useful in fluid applications, it does not show control of a transfer to two different discharge locations depending on the prevailing pressure in one discharge location.

The German Printed Patent Publication DE-OS 3,327,978 to Jörg Dantlgraber teaches a device for the charging of a pressure means storage. However, the reference teaches that the control pressure depends on the pump pressure between two values. This device does not appear to be suitable for a switching dependent on the pressure value prevailing at one of two user locations to be alternatively supplied in fluid medium.

The German Printed Patent Publication DE-OS 3,208,831 to Glyn Philip Reginald Farr teaches a control valve for a motor vehicle hydraulic plant. The reference teaches that the switch-off pressure is determined by the face of a valve seat 29 of the valve 26. In view of the fixed size of such a valve seat, there is no practical possibility for adjusting the pressure inducing the relative switch pressure levels associated with the switching process.

The German Printed Patent Publication DE-OS 2,838,115 to Glyn Philip Reginald Farr teaches the use of a hydraulic pump, which suctions hydraulic fluid from a container, where a pressure storage is subjected to a pressure fluid and where the pump acts on a relief valve in a feed line between the pump and the pressure storage, such that the pressure storage is not overloaded and allows the pump to load the pressure storage again. It appears that this hydraulic system consequently does not provide for a transport to two receiving ports dependent on and controlled by the pressure level prevailing in one of the receiving ports.

SUMMARY OF THE INVENTION

1. Purposes of the Invention

It is an object of the present invention to provide a hydraulic device for the automatic connection of a pressure source depending on the pressure in the circuit of the primary user, which can be constructed with simple components and at low production expenditures and where the device allows a sensitive setting and adjusting of the switching pressure difference for a storage-pressure dependent switching on and switching off applied to a secondary user.

It is another object of the present invention to provide for a fluid device, which allows adjustment of the pressures required for a switching in one direction and a switching in a second direction.

It is yet a further object of the present invention to provide for a fluid device, which allows a simple adjustment of the pressure difference between the switching in a first direction and the switching in a second direction.

These and other objects and advantages of the present invention will become evident from the description which follows.

2. Brief Description of the Invention

According to the present invention, there is provided for a hydraulic device for an automatic connection of a pressure source depending on a pressure level. A first valve includes a valve body, having a first end face for valve control and having a second end face, and is connected to a pressure source. A secondary user is connected to the first valve. The first valve connects the pressure means source to the secondary user. A second valve has a movable precontrol valve body and is connected to a primary user and connected to the pressure source. Said precontrol valve body has a first end face and a second end face. Said second end face faces a passage connecting the pressure source to the primary user. An auxiliary piston has a piston axis disposed in parallel to a direction of motion of the precontrol valve body and is subjected to a pressure applied to the valve body of the first valve when moving in closure direction. The auxiliary piston has a first end face and a second end face. The first end face of auxiliary piston is subjected to a pressure applied to the first end face of the valve body of the first valve. A first compression spring, engaging the first end face of the precontrol valve body, provides a restoring force to the precontrol valve body. A second compression spring is supported at its first end. The second compression spring is disposed remote relative to a position of the precontrol valve body of the second valve, by the second end face of the auxiliary piston. The second compression spring is supported at its second end by the precontrol valve body. Said second compression spring is disposed in parallel to the first compression spring and provides a restoring force to the precontrol valve body. A set screw is furnished for the auxiliary piston on its side disposed remote relative to the precontrol valve body. The adjustable stop provides via the auxiliary piston a support to the second end of the second compression spring during an operating condition, the auxiliary piston is released of pressure subjection.

The valve body of the first valve can be pressure-means controllable. Said valve body can be subjected in opening direction to the pressure of the pressure source. The valve body of the first valve can be either subjected to the pressure or released from the pressure of the pressure source in the closure direction via pressure applied to its first end face by the second valve.

The second valve can include the precontrol valve body. Said precontrol valve body can be subjected on a first side to the pressure in a circuit of the primary user and, on a second side, to the force of the first compression spring and to the force of the second compression spring against said pressure in the circuit of the primary user.

The pressure source can be automatically connected to the primary user depending on a pressure level in the circuit of the primary user. The pressure source can be automatically connected to the secondary user depending on a pressure level in the circuit of the primary user.

The set screw can be disposed such that it can serve as a support for the auxiliary piston while the first valve is open and the pressure source is connected to the secondary user. The set screw can furnish a direct support for the second compression spring.

A check valve can be disposed between the pressure source and the second valve.

The invention is associated with the advantage that the device of the recited kind can be constructed at low production expenditures and at least in part by employing standard components.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENTS

Figure 1:
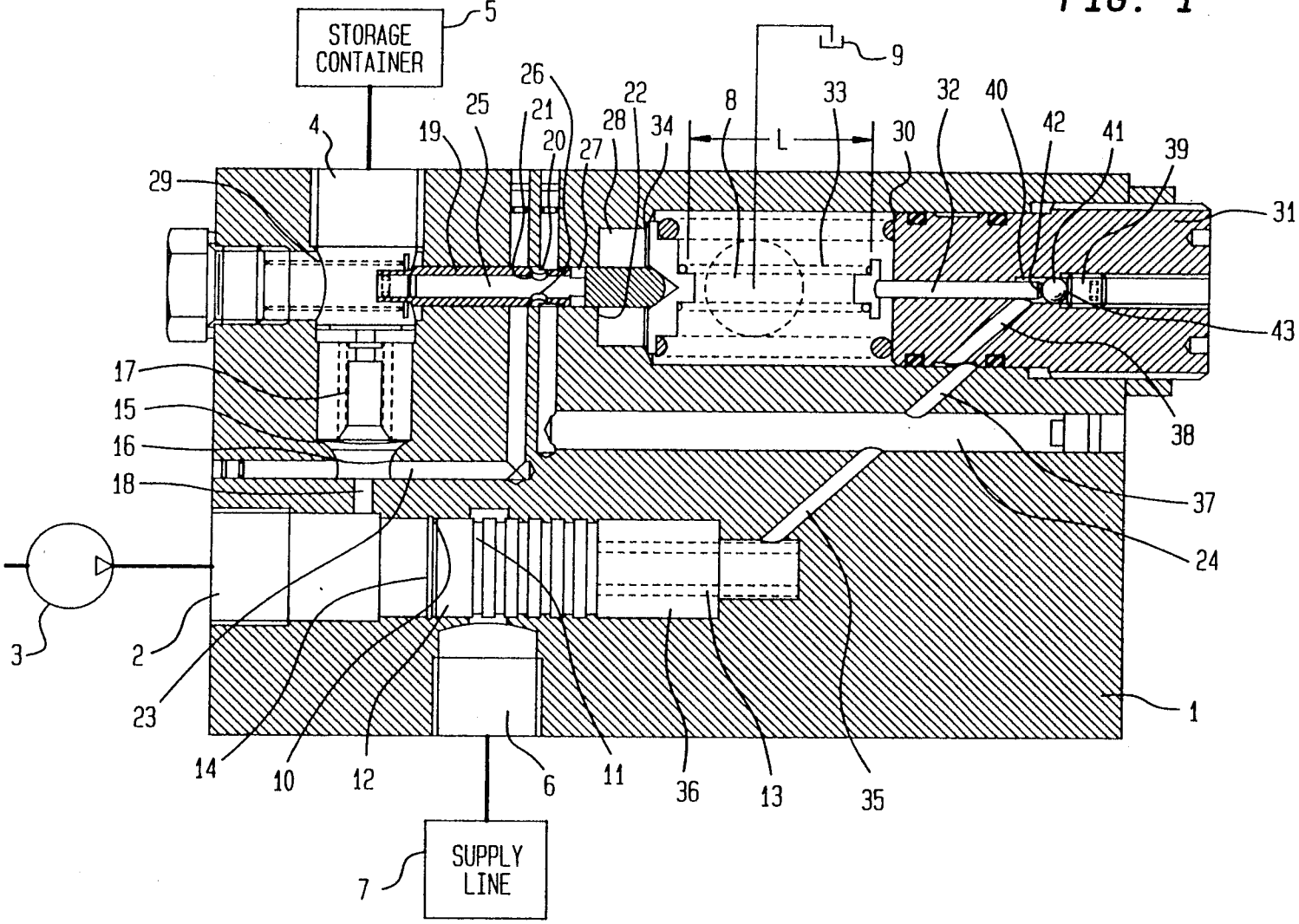
FIG. 1 is a schematic and in part sectional view of the hydraulic device of the present invention.

In accordance with the present invention, there is furnished a hydraulic device, which includes a pressure source. Depending on a pressure in a primary circuit, the pressure source is connected with a primary circuit or with a secondary circuit.

The hydraulic device includes the following features:

a) a first valve is furnished, via which the pressure means source is connectable to the secondary user;

b) the first valve exhibits a pressure means controllable valve body. Said valve body can be subjected in opening direction to the pressure of the pressure source;

c) a second valve includes a pressure controllable valve body. Said valve body is subjected on a first side to the pressure in the circuit of the primary user and has a second side. The second valve determines application of pressure and release from acting on the controllable valve body;

d) an auxiliary piston 32 is subjectable to a pressure applied to the controllable valve body 12 of the first valve 10, 11, 12 in closure direction;

e) a first compression spring subjecting the second side of the controllable valve body to the force of the second compression spring against said pressure in the circuit of the primary user;

f) a second compression spring 33 is supported at its end, disposed remote relative to the controllable valve body 19 of the second valve 19, 20, 21, 22, 27 on the auxiliary piston 32 and subjecting a second side of the controllable valve body to the force of the first compression spring against said pressure in the circuit of the primary user;

g) an adjustable stop 39 is furnished and provides a support of the end of the first compression spring 33, disposed remote relative to the valve body 19 of the second valve 19, 21, 22, 27 in an operating condition, wherein the auxiliary piston 32 is released of pressure.

The adjustable stop 39 can be disposed such that it can serve as a support for the auxiliary piston 32 while not subjected to said pressure and/or for a direct support of the first compression spring 33.

The hydraulic device illustrated in FIG. 1 comprises a casing 1, which includes an inlet port 2. A pressure source 3 is connected to the inlet port 2. An outlet port 4 is furnished at the casing 1 and is connected to a primary user, illustrated in FIG. 1, by way of a storage container 5. An outlet port 6 is furnished at the casing 1 and connected to user supply line 7. Secondary users are connected to the user supply line 7. The casing 1 is further furnished with an outlet port 8 connected to a pressureless storage container 9. It is possible to employ a plurality of secondary users. A controllable valve body 12, of the kind of a valve slider, forms a first valve operating as first valve 10, 11, 12 based on the action of the peripheral control edges 10, 11. The first valve 10, 11, 12 can be subjected to the pressure of the pressure source 3 against the force of the switching-valve spring 13. The inlet port 2 is connected with the outlet port 6 in the open state of the first valve 10, 11, 12. The open state of the first valve 10, 11, 12 is obtained by switching the controllable valve body 12 to the right as compared to the position illustrated in FIG. 1. In the closed state of the first valve 10, 11, 12, the stroke of the controllable valve body 12 is limited by a stop 14.

A valve body 15 forms a check valve 15, 16 together with a valve seat 16 of the casing 1. The check valve 15, 16 closes in the direction of the inlet port 2. The check valve 15, 16 serves for securing the circuit leading to the storage container 5 against flowback of pressurized medium in the direction of the pressure source. The check valve 15, 16 is loaded, acting in a closure direction, with a check-valve spring 17 such that the check valve 15, 16 is normally closed. The inlet port 2 is connected via a connection 18, the check valve 15, 16, and the outlet port 4 with the storage container 5.

A controllable valve body 19, of the kind of a valve slider, forms with peripheral control edges 20, 21, 22, 27 a second valve 19, 20, 21, 22, 27. The conduit line 23, subjected to the pressure of the pressure source 3, is connected with a conduit line 24 according to a first switching position of the controllable valve body 19, as illustrated in FIG. 1.

The conduit line 23 is separated from the conduit line 24 according to a second switching position of the controllable valve body 19, where the controllable valve body 19 relative to its position, as illustrated in FIG. 1, is moved towards the right-hand side. The conduit line 24 is connected to the storage container 9 via breakouts 25, 26, 27 of the controllable valve body 19, via a chamber 28, and via the outlet port 8. The controllable valve body 19 is subjected to the force of valve spring 29. The valve spring 29 retains the controllable valve body 19 against a counter support furnished by way of a valve disk 34 as long as the valve device is not subjected to pressure.

The controllable valve body 19 is subjected to the force of a first compression spring 30 on the side of the controllable valve body 19 remote relative to the valve spring 29. The force of the first compression spring 30 acting on the controllable valve body 19 can be adjusted with a set screw 31 screwed into the casing 1. An auxiliary piston 32 is guided in longitudinal direction in the set screw 31. The auxiliary piston 32 is slidable in a direction towards the controllable valve body 19. The auxiliary piston can be formed by way of a cylindrical, standard pin. A second compression spring 33 is disposed between the auxiliary piston 32 and the controllable valve body 19. The two compression springs 30 and 33 are disposed in parallel and are jointly supported on the controllable valve body 19 via the valve disk 34. A restoring spring 30, 33 is thus formed of the two compression springs 30 and 33.

The line 24 includes a first branch 35 which is connected with a pressure chamber 36 limited and terminated by the casing 1 and by the controllable valve body 12. The line 24 includes a second branch 37, 38, which is connected with the pressure chamber 40. The pressure chamber 40 is disposed in the set screw 31 and delimited by the auxiliary piston 32 and an adjustable stop 39. The tensioning length L and thus the initial tension of the second compression spring 33 can be set with the adjustable stop 39, where the tension length L of the second compression spring 33 is set in the pressureless state of the pressure chamber 40. A ball 41, disposed between the auxiliary piston 32 and the adjustable stop 39, serves for reducing wear at the active stop faces 42, 43 disposed at the auxiliary piston 32 and at the adjustable stop 39.

The mode of operation of the invention described is as follows:

FIG. 1 illustrates the operating state, where the outlet port 6 to the user supply line 7 is blocked by the controllable valve body 12 from the pressure source 3. The pressure source 3 transports fluid via the connection 18, the check valve 15, 16, and the outlet port 4, into the storage container 5 to be served primarily. At this point, the pressure in the storage volume 5 has not yet reached the required switching pressure level necessary for switching over the controllable valve body 19. Thus, the controllable valve body 19 remains in its initial switching position, as illustrated in FIG. 1, where the line 24 is subjected to the pressure of the pressure source 3. The valve body 12 is subjected to the pressure of the pressure source 3 in closing direction of the controllable valve body 12 via the first branch 35 of the line 24. The force of the switching-valve spring 13, acting in closing direction on to the controllable valve body 12, prevails versus the pressure of the pressure source 3 acting onto both front and rear sides of the controllable valve body 12.

The auxiliary piston 32 is subjected to the pressure of the pressure source 3 in the direction of the controllable valve body 19 via the second branch 37, 38, of the line 24. The controllable valve body 19 remains in the first switching position illustrated in FIG. 1 based on the forces acting on the controllable valve body 19. Said forces are caused by the pressure of the storage container 5 and of the valve spring 29, on the one hand and by the force transmitted via the auxiliary piston 32 and the second compression spring 33, which force represents the generated pressure of the pressure source applied onto the auxiliary piston 32 and which pressure lifts the auxiliary piston 32 from the stop 43, as well as by the pressure of the first compression spring 30, on the other hand.

Figure 2:
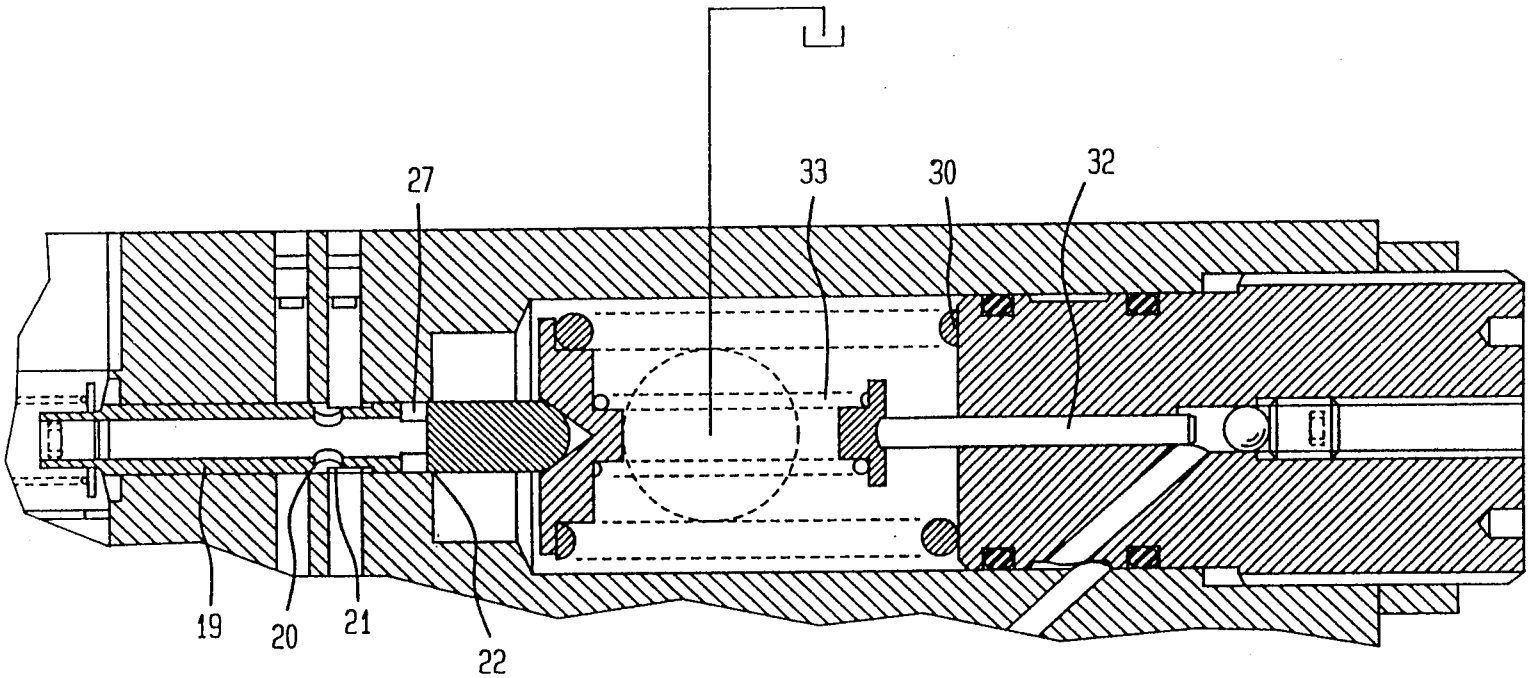
FIG. 2 is a sectional view of the hydraulic device of FIG. 1, illustrating a second switching position.
Figure 3:
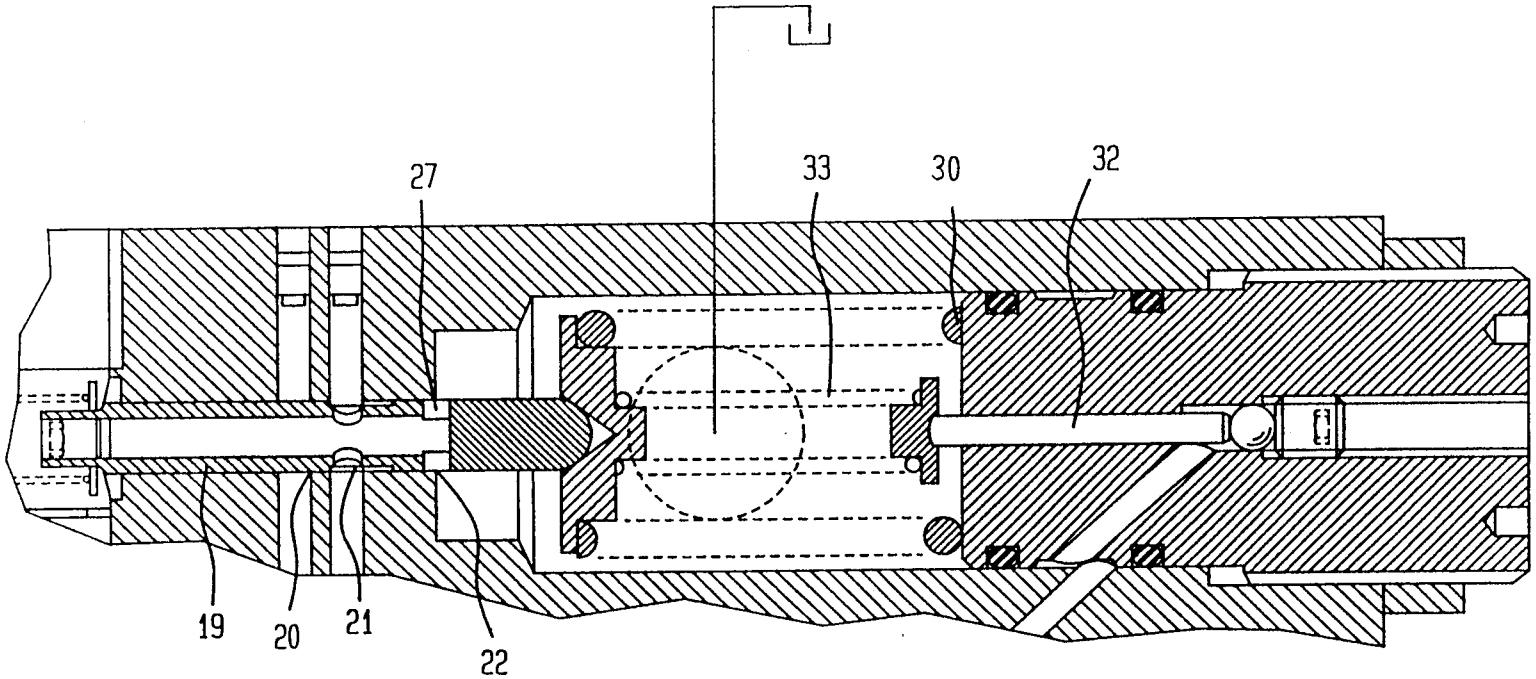
FIG. 3 is a sectional view of the hydraulic device of FIG. 1, illustrating a third switching position.

Initially, the conduit lines 23 and 24 are separated from each other upon reaching of the specified pressure in the storage container 5, which corresponds to the switching position of the controllable valve body 19 illustrated in FIG. 2. Said specified pressure corresponds to the switching pressure for actuation of the second valve part 19, 20, 21. Upon a further stroke motion of the controllable valve body 19, illustrated in FIG. 3, the lines 24, 35, 37, 38 are connected via the breakouts 25, 26, 27 and via the peripheral control edge 22 with the pressureless storage container 9 such that a pressure release occurs in the pressure chambers 40 and 36.

The pressure release of the pressure chamber 40 and the therewith connected and associated motion of the auxiliary piston 32 acts advantageously onto the stroke motion of the controllable valve body 19 during the switching process such that a speed increase and amplification of the switching process occurs.

The pressure release of the pressure chamber 36 effects that the controllable valve body 12 is now also quickly and swiftly moved into the stable switching position based on the now prevailing pressure of the pressure source 3 against the force of the switching-valve spring 13. The pressure source 3 is connected with the user supply line 7 in the stable switching position. The controllable valve body 12 is disposed shifted to the right as compared to the position illustrated in FIG. 1.

The maximum pressure in the storage container 5 is preselectable within certain given limits based on the pretension of the first compression spring 30, and the pretension can be varied with the set screw 31. A sensitive automatic control of switching pressure tolerance is achievable by the possibility of the change of the tensioning length L of the second compression spring 33 with the aid of the adjustable stop 39. The adjustable stop 39 is set such that, upon pressure release of the auxiliary piston 32, the second compression spring 33 is pretensioned corresponding to the switching pressure tolerance to be balanced and compensated.

A force remains on the valve body 19 12 based on the pretensioning such that the second switching process occurs at a higher pressure. During the second switching process, the user supply line 7 is separated from the pressure source 3 to reach the position illustrated in FIG. 1 and the storage container 5 is loaded. The switching hysteresis, which is based on the hydraulically acting face area ratio between the face area of the controllable valve body 19 and the face area of the auxiliary piston 32, is thereby rendered in part ineffective. However, the sufficiently large face of the auxiliary piston 32, acts in the critical moment of the switching over in order to assure a safe transition into the second switching position.

Figure 4:
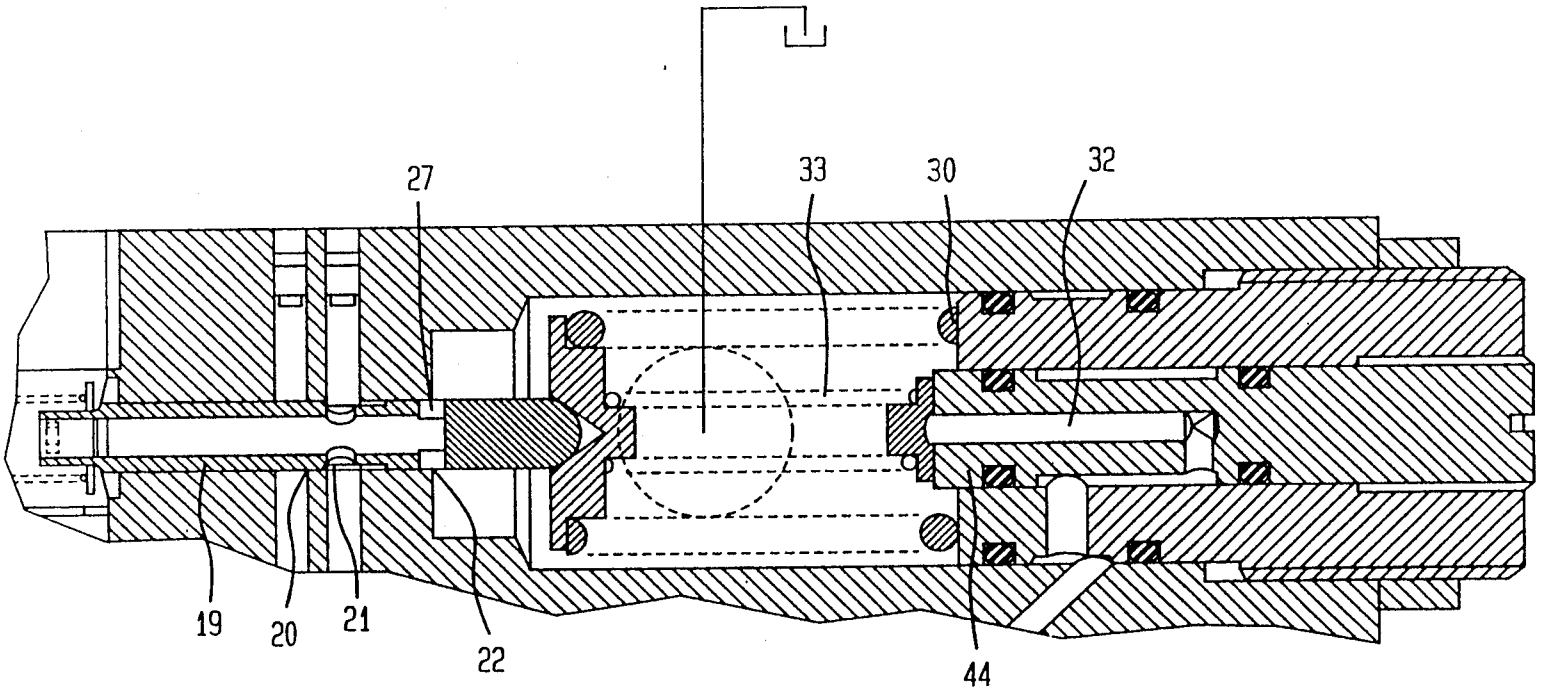
FIG. 4 is a sectional view of a second embodiment of a hydraulic device

Alternatively, as compared to the embodiment including the adjustable stop 39, a stop 44 can be disposed, as shown in FIG. 4, such that the second compression spring 33 is supported on the adjustable stop 44, while the position of the valve actuating member, the auxiliary piston 32, is undetermined and indefinite in the pressure-released state, i.e. it is not defined by a detent stop.

The switching-valve spring 13 controls and limits the size of the pressure drop in line 35 immediately for switching the first valve 10, 11, 12 from the position illustrated in FIG. 1 to an open position for connecting the pressure source 3 to the user supply line 7. The valve spring 29 is provided such that the controllable valve body 19 remains in its primary position illustrated in FIG. 1 while the pressure of the pressure source is acting on the auxiliary piston 32. The first compression spring 30 serves to retain the controllable valve body 19 in the position illustrated in FIG. 1 against the force of the valve spring 29 together with the pressure coming from the pressure supply source. The second compression spring 33 serves to determine pressure differential between the actuation of motion of the valve body 19 in one direction versus its operation in second direction.

It will be understood that each of the elements described above, or two or more together, may also find a useful application in other types of hydraulic devices for the automatic connection of a pressure means sources differing from the types described above.

While the invention has been illustrated and described as embodied in the context of a hydraulic device for the automatic connection of a pressure means source it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydraulic device for an automatic connection of a pressure source, depending on a pressure in a circuit of a primary user, either preferably with the primary user, or with a secondary user, including the following features:

a) a first valve is furnished, via which the pressure source is connectable to the secondary user;

b) the first valve including a first pressure controllable valve body, wherein said first controllable valve body is subjectable in opening direction to the pressure of the pressure source;

c) a second valve including a second pressure controllable valve body, wherein said second controllable valve body is subjected on a first side to the pressure in the circuit of the primary user and having a second side and wherein the second valve determines application of pressure and release from pressure acting on the first controllable valve body;

d) an auxiliary piston subjectable to a pressure to be applied to the first controllable valve body of the first valve in closure direction;

e) a first compression spring acting on said second side of the second controllable valve body acting against said pressure in the circuit of the primary user;

f) a second compression spring is supported at its end, disposed remote relative to the controllable valve body of the second valve on the auxiliary piston and subjecting said second side of the controllable valve body to the force of the second compression spring against said pressure in the circuit of the primary user;

g) an adjustable stop supporting the end of the second compression spring, disposed remote relative to the valve body of the second valve in an operating condition, when the auxiliary piston is released of pressure in this operating condition.

2. The hydraulic device according to claim 1, wherein the adjustable stop is disposed such that it serves as a support for the auxiliary piston while not subjected to said pressure.

3. The hydraulic device according to claim 1, wherein the adjustable stop is disposed such that it serves for a direct support of the second compression spring.

4. A hydraulic device for an automatic connection of a pressure source depending on a pressure level comprising a pressure source;

a first valve including a valve body and connected to the pressure source;

a primary user;

a secondary user connected to the first valve, wherein the first valve connects the pressure source to the secondary user;

a second valve having a movable precontrol valve body and connected to the primary user and connected to the pressure source;

an auxiliary piston having a piston axis disposed in parallel to a direction of motion of the precontrol valve body and subjected to a pressure applied to the valve body of the first valve when moving in closure direction;

a first compression spring providing a restoring force to the precontrol valve body;

a second compression spring supported at its first end, disposed remote relative to a position of the precontrol valve body of the second valve, by the auxiliary piston, the second compression spring being supported at its second end by the precontrol valve body and, said second compression spring being disposed in parallel to the first compression spring and providing a restoring force to the precontrol valve body;

a set screw furnished for the auxiliary piston on its side disposed remote relative to the precontrol valve body and providing via the auxiliary piston a support to a first end of the second compression spring during an operating condition wherein the auxiliary piston is released of pressure subjection in said operating condition such that the forces of the first compression spring and of the second compression spring act on the same side of the set screw.

5. The hydraulic device according to claim 4, wherein the valve body of the first valve is pressure-means controllable, wherein said valve body can be subjected in opening direction to the pressure of the pressure source, and can be either subjected to the pressure or released from the pressure of the pressure source in the closure direction via the second valve.

6. The hydraulic device according to claim 4, wherein the second valve includes the precontrol valve body, wherein said precontrol valve body is subjected on a first side to the pressure in a circuit of the primary user and is subjected on a second side to the force of the first compression spring and to the force of the second compression spring against said pressure in the circuit of the primary user.

7. The hydraulic device according to claim 4, wherein the pressure source is automatically connected to the primary user depending on a pressure level in the circuit of the primary user.

8. The hydraulic device according to claim 4, wherein the pressure source is automatically connected to the secondary user depending on a pressure level in the circuit of the primary user.

9. The hydraulic device according to claim 4, wherein the set screw is disposed such that it serves as a support for the auxiliary piston while the first valve is open and the pressure source is connected to the secondary user.

10. The hydraulic device according to claim 4, wherein the set screw furnishes a direct support for the first compression spring.

11. The hydraulic device according to claim 4 further comprising a check valve disposed between the pressure source and the second valve.

12. A hydraulic device for an automatic connection of a pressure source depending on a pressure level comprising a pressure source;

a first valve including a valve body having a first end face for valve control and having a second end face, said first valve being connected to the pressure source;

a primary user;

a secondary user connected to the first valve, wherein the first valve connects the pressure source to the secondary user;

a second valve having a precontrol valve body having a first end face and having a second end face, said second end face facing a passage connecting the pressure source to the primary user;

an auxiliary piston having a piston axis disposed in parallel to the precontrol valve body and having a first end face and having a second end face, and wherein the first end face of the auxiliary piston is subjected to the pressure to be applied to the first end face of the valve body of the first valve;

a first compression spring engaging the first end face of the precontrol valve body and providing a restoring force to the precontrol valve body;

a second compression spring supported at its first end, disposed remote relative to a position of the precontrol valve body of the second valve, by the second end face of the auxiliary piston, the second compression spring being supported at its second end by the precontrol valve body, and said second compression spring being disposed in parallel to the first compression spring and providing a restoring force to the precontrol valve body while the auxiliary piston is not subject to pressure;

an adjustable stop furnished for the auxiliary piston on its side disposed remote relative to the precontrol valve body and providing via the auxiliary piston a support to the second end of the second compression spring during such an operating condition, wherein the auxiliary piston is released of pressure subjection.

13. The hydraulic device according to claim 12, wherein the valve body of the first valve is pressure-means controllable, wherein said valve body is subjectable in opening direction to the pressure of the pressure source, and either is subjectable to the pressure or is releasable from the pressure of the pressure source in the closure direction via pressure applied to its first end face by the second valve.

14. The hydraulic device according to claim 12, wherein the second valve includes the precontrol valve body, wherein said precontrol valve body is subjected on a first side to the pressure in a circuit of the primary user and is subjected on a second side to the force of the first compression spring and to the force of the second compression spring against said pressure in the circuit of the primary user.

15. A hydraulic device for an automatic connection of a pressure source depending on a pressure level comprising a pressure source;

a first valve including a valve body and connected to the pressure source;

a primary user;

a secondary user connected to the first valve, wherein the first valve connects the pressure source to the secondary user;

a second valve having a movable precontrol valve body and connected to the primary user and connected to the pressure source;

an auxiliary piston having a piston axis disposed in parallel to a direction of motion of the precontrol valve body and subjected to the pressure to be applied to the valve body of the first valve when moving in closure direction;

a first compression spring providing a restoring force to the precontrol valve body;

a second compression spring support at its first end, disposed remote relative to a position of the precontrol valve body of the second valve, by the auxiliary piston, the second compression spring being supported at its second end by the precontrol valve body, and said second compression spring being disposed in parallel to the first compression spring and providing a restoring force to the precontrol valve body;

a set screw for the auxiliary piston on its side disposed remote relative to the precontrol valve body and providing via the auxiliary piston a support to the second end of the second compression spring during an operating condition, wherein the auxiliary piston is released from pressure subjection such that the forces of the first compression spring and of the second compression spring act on the same side of the set screw.

16. The hydraulic device according to claim 15, wherein the valve body of the first valve is pressure-means controllable, wherein said valve body is subjectable in opening direction to the pressure of the pressure source, and either is subjectable to the pressure or is releasable from the pressure of the pressure source in the closure direction via pressure applied to its first end face by the second valve.

17. The hydraulic device according to claim 15, wherein the second valve includes the precontrol valve body, wherein said precontrol valve body is subjected on a first side to the pressure in a circuit of the primary user and is subjected on a second side to the force of the first compression spring and to the force of the second compression spring against said pressure in the circuit of the primary user.

* * * * *